US006036423A

United States Patent [19]

Westra et al.

[11] Patent Number: 6,036,423

[45] Date of Patent: Mar. 14, 2000

[54] COIL INSERTER FOR BINDING A STACK OF SHEETS TOGETHER

[76] Inventors: Michael A. Westra, 1234 Sheldon; Todd M. Huizingh, 100 Washington, #304; John E. Melton, 1203 Washington Ave., all of Grand Haven, Mich. 49417; Christopher C. Toll, 2839 Stardust Dr.; Jeffrey A. Swaim, 4390 Kapalua Dr., both of Santa Maria, Calif. 93455

[21] Appl. No.: 09/178,136

[22] Filed: Oct. 23, 1998

[51] Int. Cl.[7] ..... B42B 5/10

[52] U.S. Cl. ..... 412/38; 412/39; 412/9

[58] Field of Search ..... 412/38, 39, 9

[56] References Cited

U.S. PATENT DOCUMENTS

| | | | |
|---|---|---|---|
| D. 365,580 | 12/1995 | Stiles et al. . | |
| D. 376,607 | 12/1996 | Mar et al. . | |
| 2,240,903 | 5/1941 | Freundlich . | |
| 2,973,199 | 2/1961 | Biel et al. . | |
| 3,407,851 | 10/1968 | Ostermeier . | |
| 3,459,242 | 8/1969 | Schmidt . | |
| 3,826,290 | 7/1974 | Pfaffle . | |
| 3,924,664 | 12/1975 | Pfaffle . | |
| 4,020,516 | 5/1977 | Gomez . | |
| 4,129,156 | 12/1978 | Pfaffle . | |
| 4,129,913 | 12/1978 | Pfaffle . | |
| 4,137,860 | 2/1979 | Yoneji et al. | 112/277 |
| 4,157,821 | 6/1979 | Fabrig . | |
| 4,161,196 | 7/1979 | Fabrig . | |
| 4,185,668 | 1/1980 | Harbert . | |
| 4,208,750 | 6/1980 | Pfaffle . | |
| 4,228,830 | 10/1980 | Boyadjian . | |
| 4,232,858 | 11/1980 | Fabrig . | |

(List continued on next page.)

FOREIGN PATENT DOCUMENTS

| | | |
|---|---|---|
| 910561 | 9/1972 | Canada . |
| 700090 | 2/1931 | France . |
| 701824 | 8/1939 | Germany . |
| 1041919 | 8/1957 | Germany . |
| 1293127 | 10/1965 | Germany . |
| 2655262 | 12/1976 | Germany . |
| 2703718 | 1/1977 | Germany . |
| 2909690 | 3/1979 | Germany . |
| 7902236 | 3/1979 | Netherlands . |
| 8500443 | 2/1985 | Netherlands . |
| 295097 | 12/1953 | Switzerland . |
| 2044676 | 10/1980 | United Kingdom . |

*Primary Examiner*—Willmon Fridie, Jr.
*Assistant Examiner*—Alisa L. Thurston
*Attorney, Agent, or Firm*—Price, Heneveld, Cooper, DeWitt & Litton

[57] ABSTRACT

A compact and portable coil inserting machine for binding stacks of sheets having a plurality of perforations along a first side edge. The machine includes a frame having a support surface configured to support a stack of sheets thereon. A power roller is rotatably mounted to the frame, and extends along at least a portion of the support surface to drive a helical coil through the perforations in the stacked sheets. The coil-inserting machine further includes at least one guide that is movably mounted to the frame, and shifts between first and second positions. The guide includes a first concave guide surface that abuts an opposite side edge of the stacked sheets when the guide is in the first position, such that the perforations in the stacked sheets form a curved passageway corresponding to the curvature of a first coil size. The guide also includes a second concave guide surface defining a second curvature corresponding to the curvature of a second size of helical coil that is different than the size of the first coil. The second guide surface abuts the stacked sheets when the guide is in the second position, such that the perforations in the stacked sheets form a curved passageway corresponding to the curvature of a second coil size and facilitate insertion of the second-sized coil in the perforations. The guide can be quickly and easily reconfigured to accommodate helical coils of different sizes to facilitate insertion of the various coils through the perforations of the stacked sheets.

23 Claims, 6 Drawing Sheets

U.S. PATENT DOCUMENTS 4,237,568 12/1980 Kunzmann .
4,249,278 2/1981 Pfäffle .
4,300,406 11/1981 Negro et al. .
4,403,896 9/1983 Fabrig .
4,425,773 1/1984 Fabrig .
4,426,871 1/1984 Fabrig .
4,482,279 11/1984 Jones et al. .
4,537,545 8/1985 Kunzmann .
4,645,399 2/1987 Scharer .
4,708,560 11/1987 Abildgaard et al. .
4,758,125 7/1988 Wahl .
5,273,387 12/1993 Groswith, III et al. .
5,324,154 6/1994 Jones et al. .
5,527,141 6/1996 Malmstrom .
5,584,632 12/1996 Stiles et al. .
5,669,747 9/1997 Scharer .
5,695,308 12/1997 Hastings et al. ..... 412/39
5,785,479 7/1998 Battisti et al. .

COIL INSERTER FOR BINDING A STACK OF SHEETS TOGETHER

BACKGROUND OF THE INVENTION

The present invention relates to a coil inserter for binding sheets, and in particular to a compact portable coil inserter that can be quickly and easily adapted to accommodate a variety of sizes and types of helical coils and stacked sheets.

Stacked sheets of paper may be bound together by inserting a spiral or helical coil into a row of perforations along a side edge of the sheets during fabrication of spiral-bound notebooks, calendars, and the like. Coiling machines used for fabrication of spiral-bound notebooks and the like are often specially made, large machines designed for high volume production. Such machines are relatively expensive, such that high volume rates of production are required to justify the capital investment in the machinery. Smaller, "table top," coil inserting machines have been developed for inserting helical coils in stacks of sheets when a relatively low number of the reports, manuals, or the like are being produced. Such machines may be used at, for example, a commercial photocopying establishment. Customers may require binding of various types and numbers of sheet stock, requiring a range of coil sizes. High volume fabricating machines used to manufacture large volumes of spiral-bound notebooks and the like are generally not cost-effective for such applications, and further, cannot be readily reconfigured to handle various coil sizes and/or sheet stock types.

Helical coils may be made from a variety of materials, such as polymers and metals. Helical coils are available in a variety of diameters corresponding to the overall thickness of the stacked sheet of papers or other sheets of material being bound together. During insertion of the coil, the coil is rotated and positioned along the side edge of the sheets having the perforations, such that the end of the coil travels through the passageway formed by the aligned perforations in the sheets. Various problems have been encountered during the coil insertion process, including the tendency of the end of the coil to catch, or otherwise become stuck, preventing further rotation and insertion of the coil in the stack of sheets, especially when the stack of sheets is quite thick. Furthermore, because existing machines may be useable with a relatively limited number of coil sizes, different machines may be required for extra large or small coil sizes corresponding to thick or thin stacks of sheets. The stacked sheets may include tabbed stock having an irregular side edge due to the tab opposite the edge having the row of perforations. The irregular edge may create difficulty in aligning the perforations for insertion of the helical coil. Accordingly, a coil-inserting machine solving the above-identified problems is needed.

SUMMARY OF THE INVENTION

One aspect of the present invention is a compact and portable coil inserting machine for binding stacks of sheets that have a plurality of perforations along a first side edge. The machine includes a frame having a support surface configured to support a stack of sheets thereon. The support surface defines a first side portion. A powered roller is rotatably mounted to the frame, and extends along at least a portion of the first side portion of the support surface. The powered roller drives a helical coil through the perforations in the stacked sheets positioned on the support surface. The coil-inserting machine further includes at least one guide that is movably mounted to the frame, and shifts between at least first and second positions. The guide is positioned in a spaced-apart relationship from the roller, and the guide includes a first concave guide surface defining a first curvature corresponding to the curvature of a first size of helical coil. The first guide surface abuts an opposite side edge of the stacked sheets when the guide is in the first position, such that the perforations in the stacked sheets form a curved passageway corresponding to the curvature of a first coil size to facilitate insertion of the coil in the perforations. The guide also includes a second concave guide surface defining a second curvature corresponding to the curvature of a second size of helical coil that is different than the size of the first coil. The second guide surface abuts an opposite side edge of the stacked sheets when the guide is in the second position, such that the perforations in the stacked sheets form a curved passageway corresponding to the curvature of a second coil size and facilitate insertion of the second-sized coil in the perforations. The guide can be quickly and easily reconfigured to accommodate helical coils of different sizes to facilitate insertion of the various coils through the perforations of the stacked sheets.

Another aspect of the present invention is a compact and portable coil inserting machine for binding stacks of sheets having perforations along a first side edge. The coil-inserting machine includes a frame and a motor mounted to the frame. A table is movably mounted to the frame and defines a support surface configured to support a stack of sheets thereon. The support surface defines an elevated first side, and an opposite side. The support surface is sloped with the first side at a higher elevation than the opposite side, such that the stacked sheets tend to slide downwardly towards the opposite side due to gravity. The coil inserting machine also includes at least one guide mounted to the table and spaced-apart from the first side thereof. The guide abuts a side edge of the stacked sheets and prevents the sheets from sliding downwardly beyond a selected position on the support surface. A roller is rotatably mounted to the frame adjacent the first side of the support surface. The roller abuttingly engages and rotates a helical coil, and inserts the coil in the perforations of the sheets. The machine further includes a shaker device connected to the motor, and interconnecting the frame and the table, whereby actuation of the motor moves the table relative to the frame in a vibrating manner to urge the sheets downwardly against the guide to a position wherein the perforations are aligned to facilitate insertion of the helical coil.

Another aspect of the present invention is a coil inserting machine for binding a stack of sheets that includes at least one sheet of tabbed stock, the sheets having perforations along a first side edge. The machine includes a frame including a support surface configured to support a stack of sheets thereon. The support surface defines a first side portion. The coil-inserting machine includes a coil driver mounted to the frame and rotating a helical coil through the perforations in the sheets. A guide is mounted to the frame and abuts an opposite side edge of the sheets to align the perforations during coil insertion. The guide includes a pair of spaced-apart support surfaces that abut a narrow edge portion of the tabbed sheet stock. The guide includes a cleared out portion between the spaced-apart support surfaces to provide clearance for the tab of the tabbed stock, and permitting alignment of the perforations during insertion of the helical coil.

Yet another aspect of the present invention is a compact and portable coil inserting machine for binding stacks of sheets having perforations along a first side edge. The machine includes a frame including a support surface shaped to support and position a stack of sheets with the perforations aligned to formed passages therethrough. An electric motor is mounted to the frame. A coil driver is mounted to the frame and is connected to the electric motor, such that actuation of the electric motor rotates the helical coil and drives the helical coil through the passageways formed by the perforations in the sheets. The coil-inserting machine further includes a foot pedal connected to the electric motor and selectively varying the rotational rate of the electric motor as the position of the foot pedal is varied by an operator.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
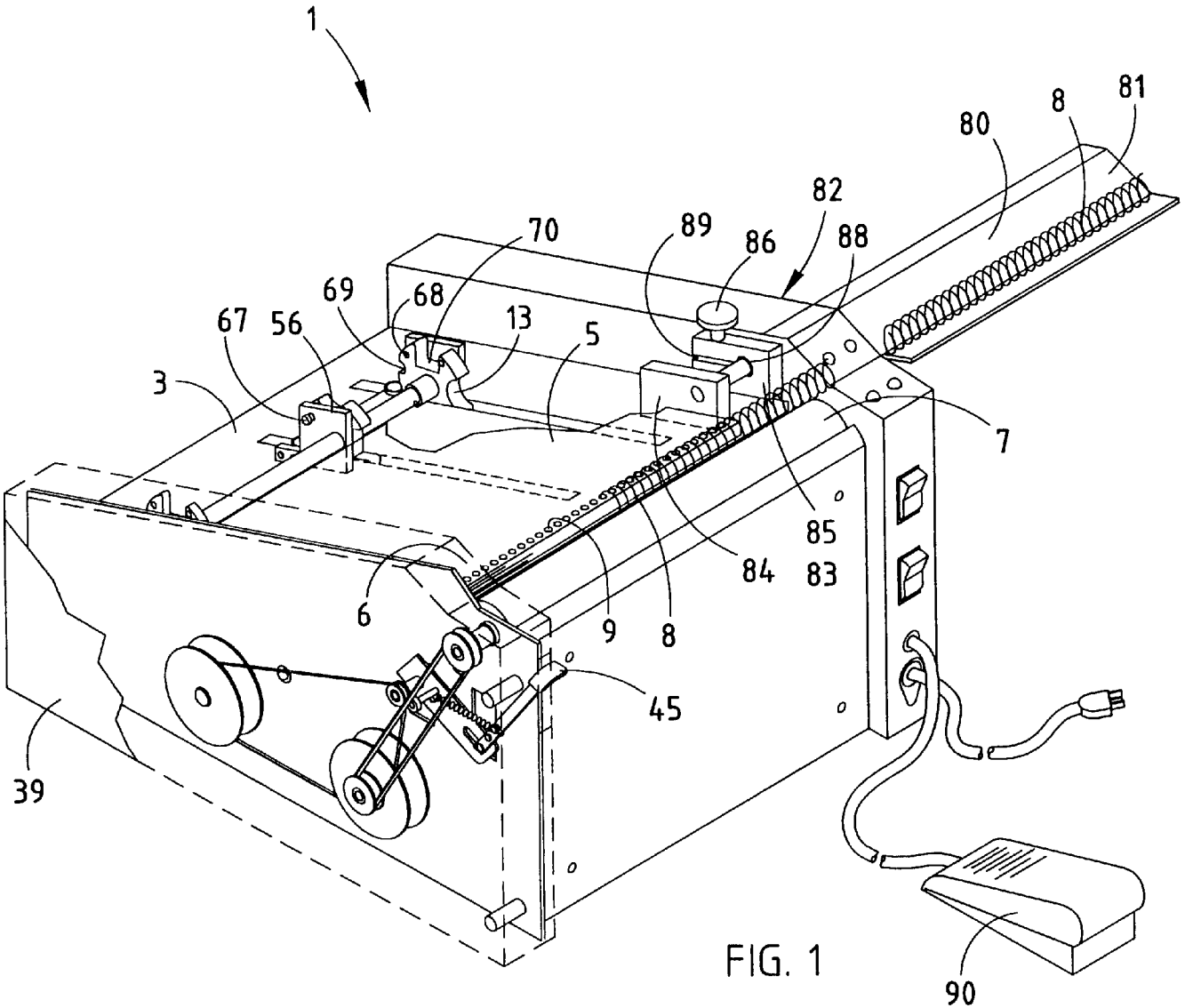
FIG. 1 is a perspective view of a coil inserting machine embodying the present invention with the guide positioning device removed for clarity.

For purposes of description herein, the terms "upper," "lower," "right," "left," "rear," "front," "vertical, " "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a coil-inserting machine embodying the present invention. In the illustrated example, coil-inserting machine 1 includes a frame 2 (FIG. 2) including a table 3 with a support surface 4 configured to support a book or stack of sheets 5 thereon. The support surface 4 defines a first side portion 6. A powered roller 7 is rotatably mounted to the frame 2, and extends along at least a portion of the first side portion 6 of support surface 4 and drives a spiral or helical coil 8 through the perforations 9 in the stacked sheets 5 on the support surface 4. At least one guide 10 is movably mounted to the frame 2, and shifts between at least first and second positions. The guide is positioned in a spaced-apart relationship relative to the roller 7, and includes a first concave guide surface 11 defining a first curvature corresponding to the curvature of a first size of helical coil. The first guide surface 11 abuts an opposite side edge 12 of the stacked sheets 5 when the guide 10 is in the first position, such that the perforations 9 in the stacked sheets 5 form a curved passageway 9*a* (see also FIG. 10) corresponding to the curvature of a first coil size to facilitate insertion of the coil 8 in the perforations. The guide 10 includes a second concave guide surface 13 defining a second curvature corresponding to the curvature of a second size of helical coil, the second coil size different than the first coil size. The second guide surface 13 abuts an opposite side edge 12 of the stacked sheets when the guide 10 is in the second position, such that the perforations 9 in the stacked sheets 5 form a curved passageway 9*a* corresponding to the curvature of a second coil size to facilitate insertion of the second-sized coil in the perforations 9. The guide 10 can be quickly and easily reconfigured to accommodate helical coils 8 of different sizes, and the curved guide surfaces 11 and 13 cause the perforations 9 to form a curved passageway 9*a* with a shape corresponding to the curvature of the coil 8 to facilitate insertion of the various coils through the perforations 9 of the stacked sheets 5.

Figure 2:
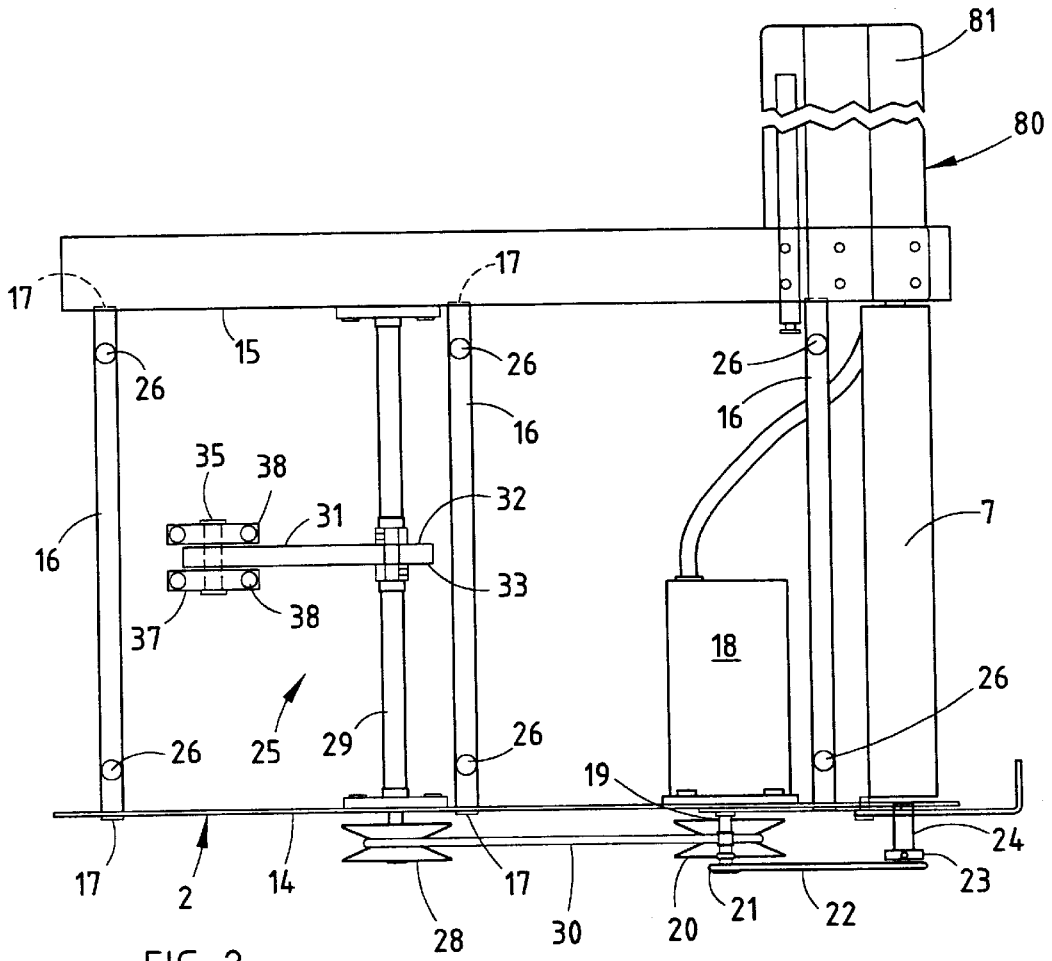
FIG. 2 is a fragmentary, top plan view illustrating the frame and pulleys.

With further reference to FIG. 2, frame 2 includes a pair of spaced-apart flat members 14 and 15 formed from sheet metal stock or the like. Three bars 16 have a square cross-sectional shape with threaded ends that receive screws 17 to secure the side members 14 and 15 together. An electric motor 18 is secured to the side member 14 using conventional fasteners or the like. A drive pulley 20 is mounted to the output shaft 19 of electric motor 18. A smaller, outer drive pulley 21 is also mounted to the output shaft 19, and an elongate, flexible member such as drive belt 22 wraps around pulley 21 and pulley 23. Pulley 23 is mounted on roller shaft 24, such that rotation of electric motor 18 rotates pulleys 21 and 23, thereby rotating roller 7. Roller 7 has an outer surface made of an elastomeric, resilient material such as rubber having a relatively high coefficient of friction that generates a force rotating the helical coil during insertion. During coil insertion, a user manually grasps the coil and rotates the coil through several perforations. Motor 18 is then turned on, rotating roller 7. The user then lowers the side edge of the stacked sheets 5, bringing the coil into contact with the rotating roller 7. Alternatively, coil 8 may be placed on roller 7, while roller 7 is not rotating. Motor 18 is then turned on to rotate roller 7, thereby rotating and inserting coil 8 through the perforations 9.

Figure 3:
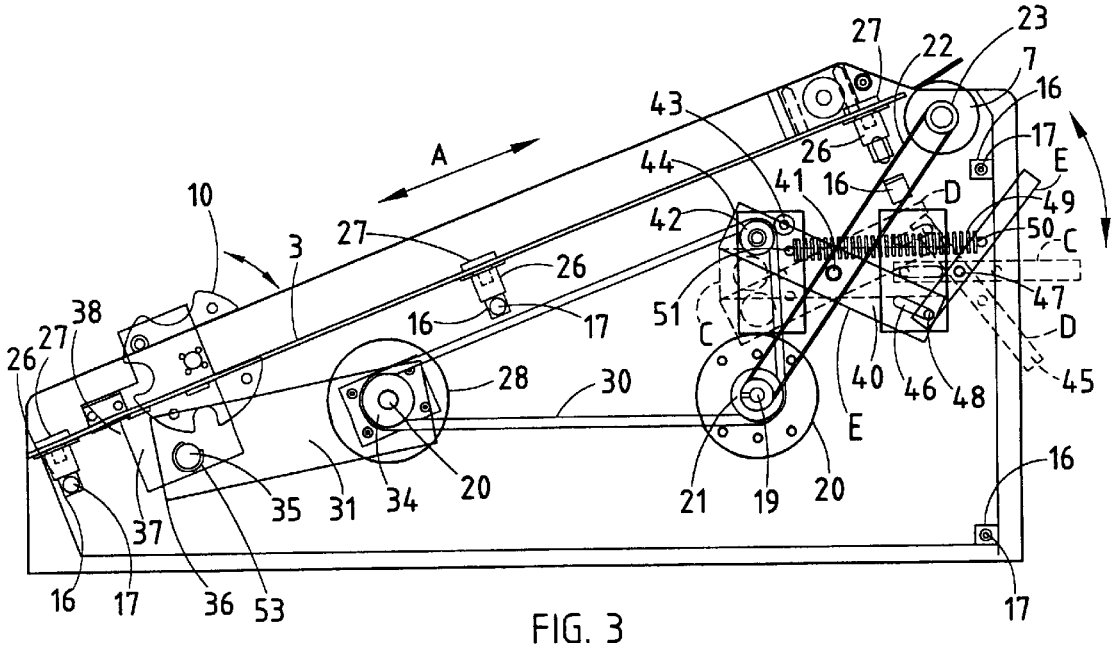
FIG. 3 is a front elevational view showing the guides and table shaker.

Table 3 is mounted to the bars 16 by resilient rubber isolators 26. Isolators 26 are cylindrical in shape, and include a threaded stud extending from a lower end that is received within a threaded hole in bar 16, and an upper end that has a threaded hole that receives a screw 27 that passes through table 3. The isolators 26 are resilient, and permit movement of the table 3 in the direction of the arrow "A" (FIG. 3), approximately parallel to the support surface 4.

The rubber isolators 26 generate a force if table 3 is moved from a neutral, center position, thereby biasing the table 3 into the center position. A shaker or "jogging" device 25 interconnects the table 3 and frame 2, and shakes or "jogs" the table 3 in a vibrating manner, thereby causing the stacked sheets of paper to slide downwardly into the desired position against guide 10. An elongate flexible member, such as belt 30, wraps around pulley 20 and pulley 28. Shaft 29 is fixed to pulley 28, and rotates therewith. An arm 31 is made from aluminum bar stock or the like, and includes a bearing 32 mounted at a first end 33 of arm 31. An eccentric 34 has a circular outer surface that is received within bearing 32, and has a center bore that closely receives shaft 29 at an offset, or eccentric location relative to the circular outer surface, such that rotation of shaft 29 causes first end 33 of arm 31 to move in a circular manner. The center bore of eccentric 34 is preferably offset about 0.020 inches from center relative to the outer surface, such that first end 33 of arm 31 has a motion defining a circle of 0.040 of an inch diameter. Second end 36 of arm 31 is pivotally connected to table 3 by a pin 35 and clevis 37. A clip 53 retains pin 35 to clevis 37, and conventional screws or other fasteners 38 secure the clevis 37 to table 3. Because the resilient isolators 26 confine the table 3 to a motion in the direction of the arrow "A," rotation of shaft 29 will shift arm 31 in a periodic manner, causing table 3 to travel about 0.020 of an inch off the center position in each direction, with a total travel of about 0.040 of an inch. As isolators 26 flex, table 3 will move slightly out of plane (i.e., orthogonal to arrow "A"), with an approximately circular motion having a radius about equal to the length of the isolators 26.

A link 40 is pivotally mounted to side member 14 by a shoulder bolt or other suitable pivot 41. A first end 44 of link 40 includes an idler pulley 42 rotatably mounted thereto, and a retainer, such as shoulder bolt 43 is mounted to link 40 directly adjacent idler pulley 42. As described below, shoulder bolt 43 retains belt 30 against idler pulley 42 even when belt 30 is slack. Handle 45 is pivotally mounted to side member 14 at 47, and includes a pin or shoulder bolt 48 that is received in slot 46 of link 40. Handle 45 pivots about 47 between an engaged position "E" and a disengaged position "D". A tension spring 49 has one end secured to handle 49 at hole 50, with an opposite end secured to hole 51 in link 40. As handle 45 rotates about pivot point 47, pin 48 slides within slot 46 of link 40, and rotates link 40 about pivot point 41. Tension spring 49 urges the handle 45 and link 40 into the engaged position "E," or into the disengaged position "D" except when handle 45 is positioned at the exact center position "C". When in the engaged position, idler pulley 42 generates tension on belt 30 due to tension spring 49, thereby causing belt 30 to frictionally engage pulleys 20 and 28, and rotating shaft 29 to actuate the shaker device. When in the disengaged position, belt 30 is slack, such that pulley 20 can rotate without rotating pulley 28 and shaft 29. This arrangement allows a single electric motor 18 to drive both the roller 7 and shaker device 25, while permitting the shaker device 25 to be engaged or disengaged as required. When in the disengaged position, shoulder bolt 43 ensures that belt 30 does not become disengaged from idler pulley 42. Pulleys 20 and 28 have a deep V-groove, such that belt 30 does not disengage from pulleys 20 and 28, even though belt 30 is slack when the shaker device 25 is disengaged. The pulleys and belts are closed off by a cover 39 (FIG. 1) during operation.

Figure 4:
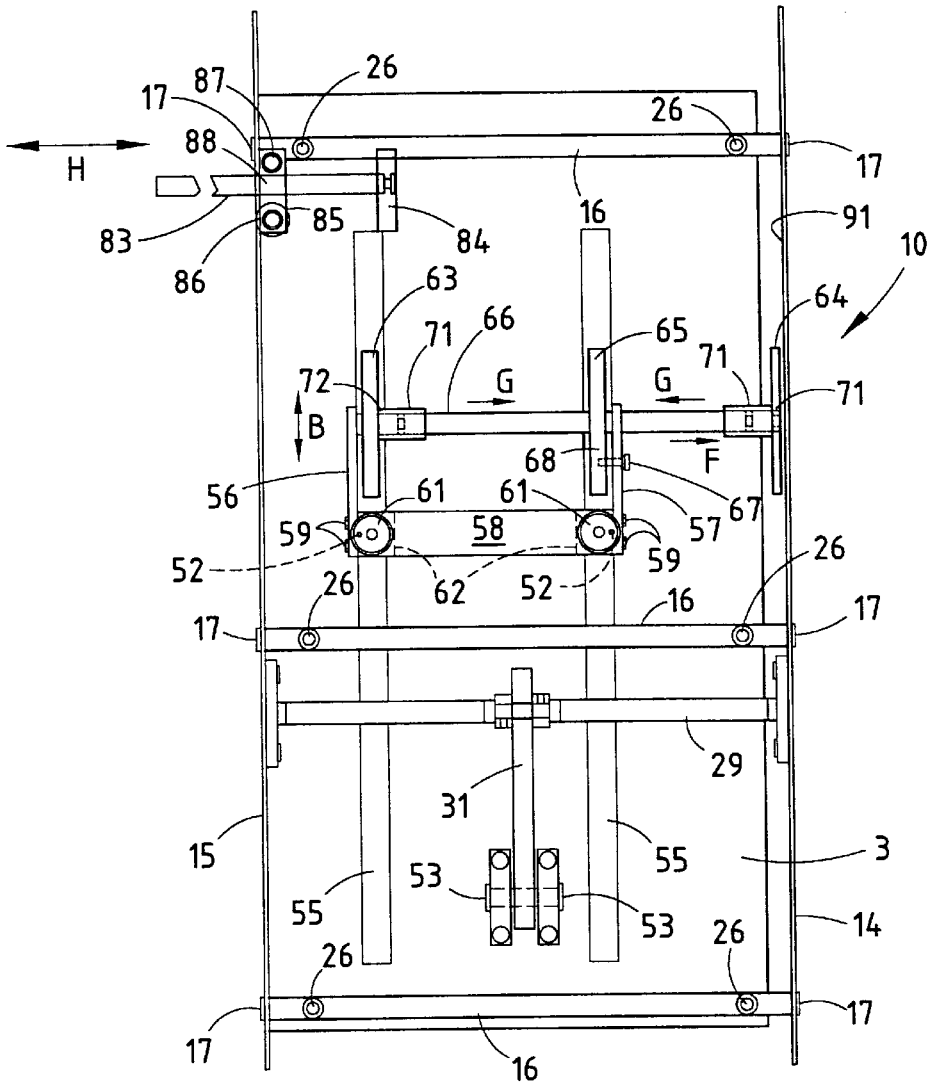
FIG. 4 is a top plan view showing the frame, shaker, and guide positioning clamp.
Figure 5:
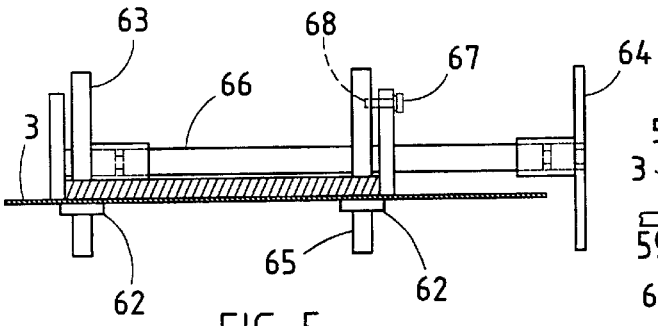
FIG. 5 is a front elevational view of the guides and guide shaft.

With reference to FIG. 4, table 3 includes a pair of elongate slots 55 to permit adjustment of the guide 10 for different size sheets by moving guide 10 in the direction of the arrow "B". Plates 56 and 57 are secured to a cross bar 58 by fasteners 59. Cross bar 58 rests on support surface 4 above table 3, and a pair of thumb screws 61 extend through clearance holes in cross bar 58 and through slots 55, and are threadably received in clamp blocks 62 positioned below table 3. Thumbscrews 61 are loosened to permit adjustment of guide 10 along slots 55 in table 3, and tightened to secure guide 10 in a selected position, according to the size of the sheet stock being used. Pins 52 are press-fit into cross bar 58 and have a lower end extending downwardly below table 3. Pins 52 are received within a clearance bore in clamp blocks 62, such that clamp blocks 62 can travel vertically, but do not rotate when thumb screws 61 are turned.

Figure 6:
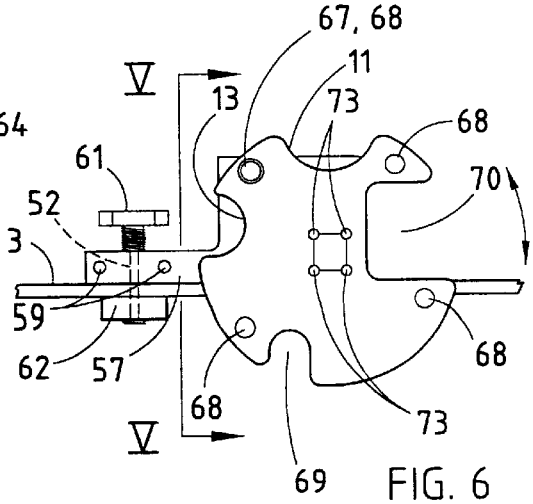
FIG. 6 is a side elevational view of the guides.
Figure 10:
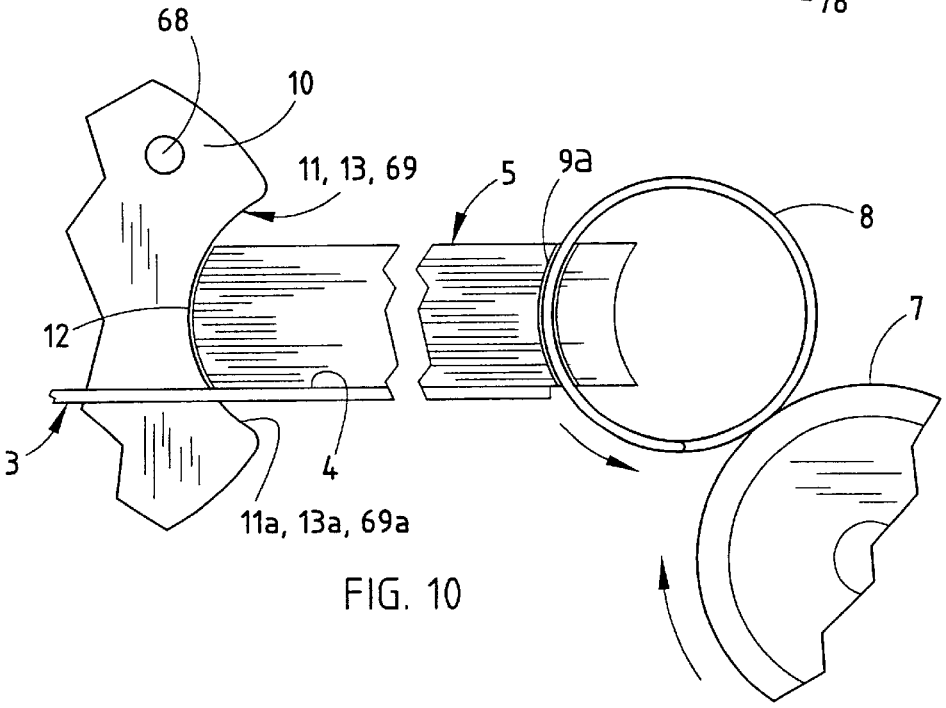
FIG. 10 is a fragmentary, side elevational view showing the arcuate passage formed by the perforations due to the curved guide surfaces.
Figure 11:
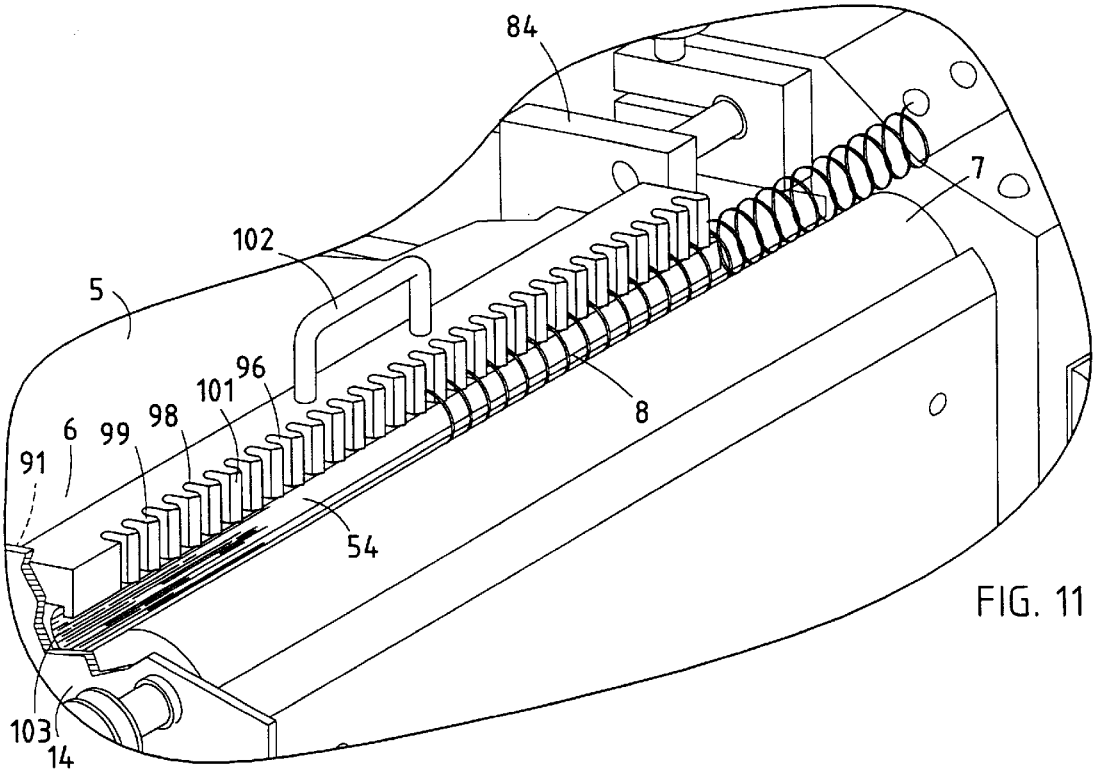
FIG. 11 is a fragmentary perspective view of the coil-inserting machine of FIG. 1 showing a coil guide/clamp.

Guide 10 can be readily reconfigured for different size coils used with different total thickness of a given stack of sheets. Guide 10 includes a pair of outer disks 63 and 64, and an intermediate disk 65. Intermediate disk 65 is fixed to the guide shaft 66, and rotates therewith. A spring loaded pin 67 is mounted to plate 57 and is biased into engagement with holes 68 in intermediate disk 65 (see also FIG. 1). Disks 63, 64, and 65 each include first, second, and third guide surfaces 11, 13, and 69, respectively. Guide surfaces 11, 13, or 69 each have a different radius for use with coils of different sizes. Each disk further includes a cleared-out, generally rectangular portion 70, that provides clearance when tabbed sheet stock is being used, as described in more detail below. Each of the guide surfaces has an arcuate shape, with a radius corresponding to that of standard helical coils. When the side edge 12 of the stacked sheets contact the guide surfaces, perforations 9 form an arcuate passage matching the curvature of the helical coil to facilitate insertion of the coil through the perforations (see also FIG. 10). The proper guide surface 11, 13, 69 (or cleared-out portion 70) portion of intermediate disk 65 can be selected by manually pulling pin 67 against the spring bias in the direction of the arrow "F" (FIG. 4). Disk 65 is then rotated until the desired guide surface is positioned to abuttingly contact the opposite side edge of the stack of sheets. As shown in FIG. 10, a lower portion 11*a*, 13*a*, and 69*a* of the selected guide surface 11, 13, and 69 extends below table 3 and support surface 4. Because a lower portion of coil 8 extends below table 3 during insertion, the positioning of the selected guide surface 11, 13, and 69 partially below table 3 permits proper alignment of passageways 9*a* for coil insertion. Pin 67 is then released to engage hole 68, thereby locking disk 65 in the selected position. Locks 71 are substantially identical to one another, and rotatably lock outer disks 63 and 64 to the shaft 66 when in the locked position. Locks 71 include a small pin 72 that is spring-biased into engagement with the small holes 73 (FIG. 6) directly adjacent shaft 66. Locks 71 can be manually grasped and shifted in the direction of the arrow "G" (FIG. 4), thereby disengaging pin 71 from holes 73. With the pins 72 disengaged, disks 63 and 64 may be rotated about shaft 66 to position a selected guide surface as required for a chosen coil size. As described below, when locks 71 are disengaged, disks 63 and 64 can each rotate relative to intermediate disk 65, such that cleared-out portion of disk 65 can be aligned with selected guide surfaces on outer disks 63 and 64 for use with tabbed stock. Locks 71 have a small pin (not shown) extending radially inwardly and engaging a slot (also not shown) extending axially along guide shaft 66 to prevent rotation of locks 71 about guide shaft 66. An E-clip (not shown) snaps onto an annular groove on shaft 66 within lock 71, and a coil spring (also not shown) fits around shaft 66 with a first end of the spring abutting an shoulder of lock 71 adjacent pin 72. A second end of the spring abuts the E-clip, thereby biasing pin 72 of lock 71 into engagement with holes 73 of outer disks 63 and 64.

Figure 7:
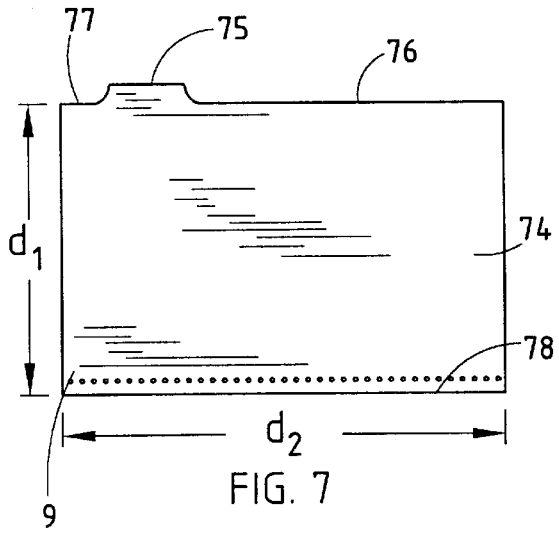
FIG. 7 is a top plan view of a sheet of tabbed stock.
Figure 8:
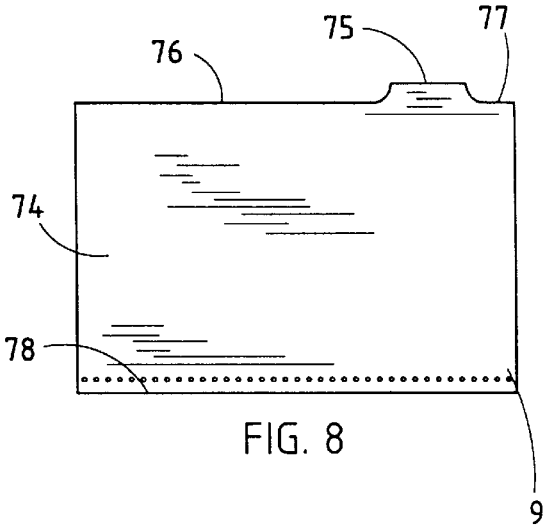
FIG. 8 is a top plan view of a sheet of tabbed stock.
Figure 9:
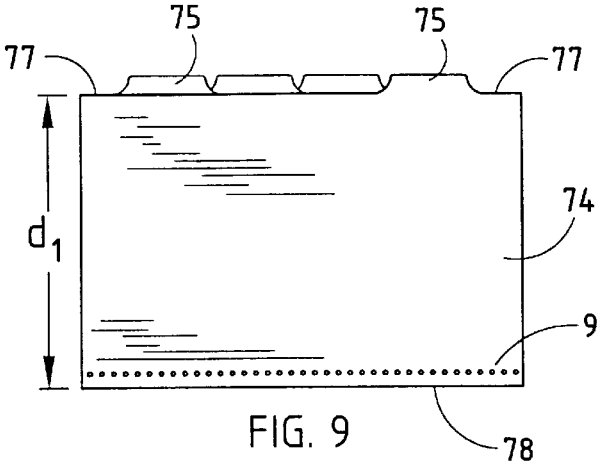
FIG. 9 is a top plan view of a stack of tabbed sheets having various tab locations.

With reference to FIGS. 7–9, conventional tabbed stock 74 includes a tab 75 that may be located at various positions along the edge 76 of the stock. The dimensions d1 and d2 correspond to a standard sheet stock size. If a tab 75 is located at the left-most position (FIG. 7), or at the right-most position (FIG. 8), a small end portion of the edge 77 will be spaced a standard distance d1 from a second edge 78 of the tabbed stock 74. Accordingly, if a stack of tabbed stock 74 has tabs 75 at various locations, the end portions 77 will still be at a standard distance d1 from the second edge 78. The guide arrangement described above permits the intermediate disk to be positioned with the cleared-out portion 70 at the support surface 4, with the outer disks 63 and 64 having a selected guide surface 11, 13 or 69 positioned adjacent the support surface. In this configuration, the cleared-out portion 70 provides clearance for the tabs 75, and the selected guide surfaces of outer disks 63 and 64 contacts the end portions 77 of the tabbed stock to position the edge 78 and perforations 9 adjacent the roller 7 for insertion of the helical coil 8. Cleared-out portion 70 does not contact tabs 75, such that end portion 77 of the tabbed stock 74 provide for the positioning of the tabbed stock 74. This arrangement permits binding of tabbed stock, or a combination of tabbed stock and other sheets.

With reference to FIG. 1, a support 80 is made from sheet metal or other suitable material, and has a generally V-shaped upper surface 81 that supports and guides a helical coil 8 during manual insertion into perforations 9. A stock guide 82 is adjustable for different sheet sizes and includes a C-block 85 that is secured to the table 3 or frame 2 by screws 87. A guide block 84 is secured to the end of shaft 83, and contacts the side edge of the stock during coil insertion to ensure that the perforations 9 remain aligned. With further reference to FIG. 4, shaft 83 is received in a bore 88 through C-block 85. Bore 88 has a diameter that is slightly larger than shaft 83, such that shaft 83 can slide in the direction of the arrow "H" for adjustment of guide block 84. A slot 89 extends transversely through C-block 85 and joins with bore 88, and thumbscrew 86 extends downwardly through the slot 89. Thumb screw 86 is threadably received in the portion of C-block 85 below slot 89, such that thumb screw 86 can be turned to clamp shaft 83 in place in a conventional manner. The sheets are thereby guided between guide block 84 and inner sidewall 91 of side frame member 14.

A foot pedal 90 is electrically connected to the motor 18, and shifts between an upper, stopped position, and a lower, maximum R.P.M. position. When in the upper stopped position, foot pedal 90 actuates a relay (not shown) that, in turn, causes an electrical resistor to be electrically connected across the terminals of the electric motor 18, thereby providing a dynamic brake that stops roller 7 and/or shaker device 25. Foot pedal 90 frees the operator's hands for guiding the coil 8 during insertion.

Figure 12:
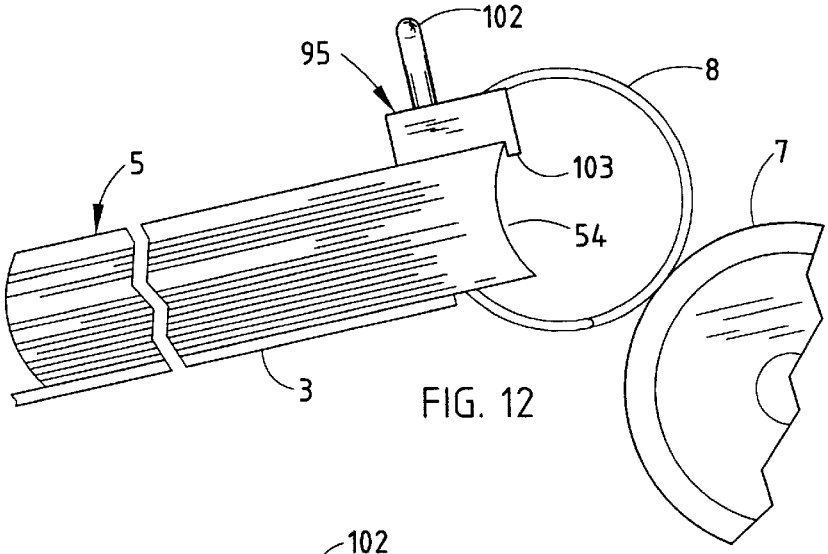
FIG. 12 is a fragmentary, partially schematic, side elevational view of the coil inserter and guide/clamp.
Figure 13:
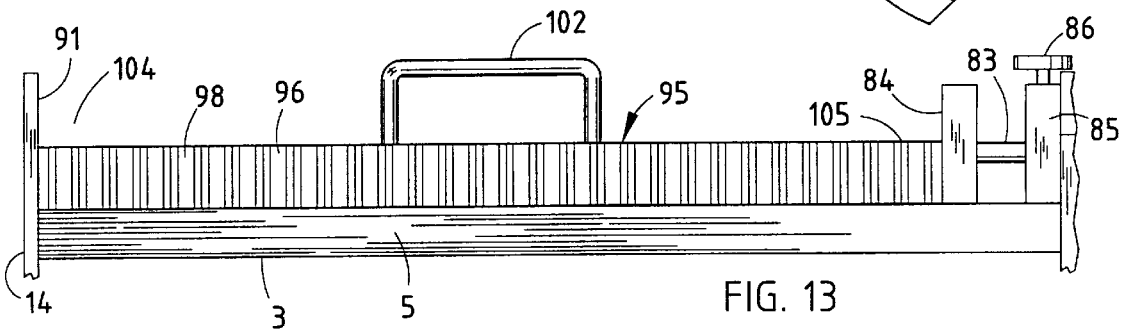
FIG. 13 is a fragmentary, partially schematic, front elevational view of the coil inserter and guide/clamp.
Figure 14:
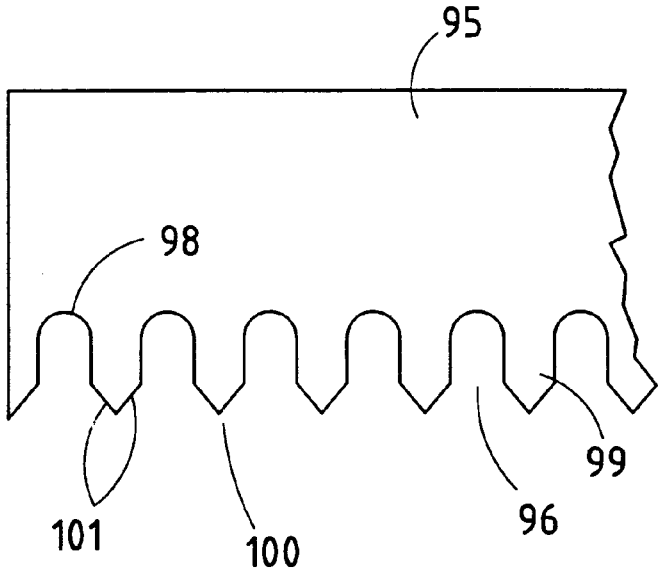
FIG. 14 is a fragmentary, top plan view of a portion of the guide/clamp showing the vertical grooves or channels.

With reference to FIGS. 11–14, a coil guide/clamp 95 may be used to assist insertion of coils that have become bent or are otherwise irregular due to manufacturing variables. Guide or clamp 95 is made of a suitable material, such as aluminum, and includes a plurality of vertically extending grooves or channels 96 along the side edge 97. Each vertical groove or channel 96 is radiused at the root 98, and the walls 99 formed between an adjacent pair of the vertical grooves 96 extend outwardly to a point 100. The point 100 is formed by chamfered faces 101 angling inwardly at about 45 degrees, forming a "chisel" point (FIG. 14). The point 100 could also have a smoothly curved or radiused shape. The points 100 guide the coil 8 during insertion, and the vertical grooves or channels 96 are aligned with the perforations 9 to facilitate insertion of the coil 8 and prevent binding. As best seen in FIG. 12, a lip 103 extends downwardly over the curved side edge 54 of the stack of sheets 5 to align the guide or clamp 95 with the perforations 9. During operation, a user grasps the handle 102 and positions the guide or clamp 95 against inner sidewall 91 of side member 14 (FIG. 13). Lip 103 is also positioned against the side edge 54 of the stack of sheets 5. In this position, the first end 104 of guide 95 abuts inner side wall 91, and the second end 105 of guide 95 is positioned directly adjacent guide block 84, such that guide 95 remains properly positioned. Guide 95 is especially useful when using large coils 8 with thicker stacks of sheets 5.

During operation, disks 63, 64 and 65 of guide 10 are rotated to place the desired guide surface 11, 13, or 69 in position by means of the adjustment provisions described above. A stack of sheets is then placed on the support surface 4 with the perforations 9 positioned adjacent the roller 7. A helical coil 8 is then grasped and manually rotated to begin the insertion. After the helical coil is inserted and rotated through several of the perforations 9, foot pedal 90 is actuated, and helical coil 8 is manually brought into contact the rotating roller 7, thereby driving the helical coil 8 through the passageways 9*a* formed by perforations 9 in the stack of sheets 5. Coil 8 can be removed by continuing rotation after the coil is fully inserted such that the coil exits the perforations. Alternatively, motor 18 can be reversed, so that coil 8 is removed. If the helical coil 8 binds, the edge of the stack of sheets can be manually raised to bring the helical coil 8 out of contact with roller 7. Helical coil 8 is then manually rotated as required to free the coil, and the coil is then brought into contact with roller 7 to complete the insertion process. If the perforations 9 are not aligned, as when some of the sheets are not abutting the guide surface 11, 13, or 69, handle 45 can be grasped, and shifted to the engaged position to cause the table 3 to vibrate as described above. Because the support surface 4 slopes downwardly away from roller 7, the sheets will tend to slide downwardly against the guide surfaces due to gravity when vibrated.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A compact and portable coil inserting machine for binding stacks of sheets having a plurality of perforations along a first side edge, said machine comprising:

a frame including a support surface configured to support a stack of sheets thereon, said support surface defining a first side portion;

a powered roller rotatably mounted to said frame and extending along at least a portion of said first side portion and driving a helical coil through the perforations in the stacked sheets on the support surface; and at least one guide movably mounted to said frame and shifting between at least first and second positions, said guide positioned in a spaced-apart relationship relative to said roller, said guide including a first concave guide surface defining a first curvature corresponding to the curvature of a first size of helical coil, said first guide surface abutting an opposite side edge of the stacked sheets when said guide is in said first position, such that the perforations in the stacked sheets form a curved passageway corresponding to the curvature of a first coil size and facilitate insertion of the first-sized coil in the perforations, said guide including a second concave guide surface defining a second curvature corresponding to the curvature of a second size of helical coil, different than the first coil size, said second guide surface abutting an opposite side edge of the stacked sheets when said guide is in said second position, such that the perforations in the stacked sheets form a curved passageway corresponding to the curvature of a second coil size and facilitate insertion of the second-sized coil in the perforations, such that said guide can be quickly and easily reconfigured to accommodate helical coils of different sizes and facilitate insertion of the various coils through the perforations of the stacked sheets.

2. A coil inserting machine as set forth in claim 1, including:

a variable speed electric motor connected to said roller and rotating the same.

3. A coil-inserting machine as set forth in claim 2, wherein:

said guide is rotatably mounted to said frame, rotation of said guide shifting said guide between said first and second positions.

4. A coil-inserting machine as set forth in claim 3, wherein:

said support surface slopes downwardly from said first side portion, such that the sheets tend to slide downwardly towards said guide due to gravity.

5. A coil-inserting machine as set forth in claim 4, wherein:

said first and second guide surfaces have an arcuate shape, such that the perforations in the stacked sheets form an arcuate passageway corresponding to the helical coil being inserted.

6. A coil-inserting machine as set forth in claim 5, wherein:

said guide includes a shaft with at least two disks mounted thereon, each disk having an edge with cutout portions defining said first and second guide surfaces.

7. A coil-inserting machine as set forth in claim 6, wherein:

said disks are spaced-apart to define outer disks such that the arcuate guide surfaces abut the narrow portion of tabbed sheet stock adjacent the side edges thereof; and said guide including an intermediate disk mounted to said shaft between said outer disks, said intermediate disk rotatable relative to said outer disks, and including at least one arcuate guide surface having the same contour as one of said first and second guide surfaces on said outer disks, said intermediate disk further including a cut-out portion providing clearance for the tab of tabbed stock.

8. A coil-inserting machine as set forth in claim 7, wherein:

said intermediate disk is fixed to said shaft;

said outer disks are rotatably mounted on said shaft; and including:

a pair of locks fixing said outer disks to said shaft in selected positions relative to said intermediate disk, such that said first and second guide surfaces may be selectively aligned with said cut-out clearance portion of said intermediate disk for inserting helical coils of various sizes through perforations in tabbed stock.

9. A coil-inserting machine as set forth in claim 8, wherein:

said outer disks include at least two holes indexed to said guide surfaces; and said locks include a pin slidably mounted to said shaft and biased into engagement with said holes in said outer disks, said pin locking said outer disks relative to said shaft when engaged with said holes.

10. A coil-inserting machine as set forth in claim 1, wherein:

at least a portion of said first guide surfaces extends below said support surface when said guide is in said first position.

11. A coil inserting machine as set forth in claim 1, including:

a coil guide disposed adjacent said roller and extending along the first side edge of stacked sheets, said coil guide including a plurality of vertically extending channels in vertical registry with the perforations, and including a downwardly extending portion configured to abut the first side edge of the stacked sheets to align said vertically extending channels with the perforations.

12. A compact and portable coil inserting machine for binding stacks of sheets having perforations along a first side edge, said coil inserting machine comprising:

a frame;

a motor mounted to said frame;

a table movably mounted to said frame and defining a support surface configured to support a stack of sheets thereon, said support surface defining an elevated first side and an opposite side, said support surface sloped with said first side at a higher elevation than said opposite side, such that the stacked sheets tend to slide downwardly towards said opposite side due to gravity;

at least one guide mounted to said table and spaced-apart from said first side thereof, said guide abutting a side edge of the stacked sheets and preventing the sheets from sliding downwardly beyond a selected position on said support surface;

a roller rotatably mounted to said frame adjacent said first side of said support surface and abuttingly engaging and rotating a helical coil and inserting the coil in the perforations of the sheets; and a shaker device connected to said motor and interconnecting said frame and said table, actuation of said motor moving said table relative to said frame in a vibrating manner to urge the sheets downwardly against said guide to a position wherein the perforations are aligned to facilitate insertion of the helical coil.

13. A coil-inserting machine as set forth in claim 12, including:

at least one resilient isolator interconnecting said table with said frame and biasing said table into a neutral, center position relative to said frame.

14. A coil-inserting machine as set forth in claim 13, including:

an eccentric connected to said motor; and an arm interconnecting said eccentric and said table, rotation of said eccentric laterally shifting said table in a periodic manner.

15. A coil-inserting machine as set forth in claim 14, wherein:

said motor comprises an electric motor having a rotating output shaft; and including:

an elongate flexible member forming a loop;

a first pulley mounted to said output shaft of said motor for rotation therewith;

a second pulley mounted to said eccentric for rotation therewith;

an idler pulley movably mounted to said frame and shifting between engaged and disengaged positions; and:

said flexible member wrapped around said first and second pulleys and said idler pulley, such that said flexible member is tensed and frictionally engages and rotates said second pulley and said eccentric and vibrates said table when said idler pulley is in said engaged position, said flexible member slack when said idler pulley is in said disengaged position, thereby permitting rotation of said first pulley without vibrating said table.

16. A coil-inserting machine as set forth in claim 15, wherein:

said elongate flexible member comprises a first flexible member, and including:

a second elongate flexible member wrapped around said output shaft and said roller and rotating said roller upon rotation of said motor.

17. A coil-inserting machine as set forth in claim 16, wherein:

said idler pulley is mounted on an arm, said arm pivotally mounted to said frame and shifting said idler pulley between said engaged and disengaged positions, said arm biased into said engaged position.

18. A coil-inserting machine as set forth in claim 17, wherein:

said guide has an arcuate guide surface that abuts the side edge of the stacked sheets, the perforations forming an arcuate passage during insertion of a helical coil.

19. A coil inserting machine for binding a stack of sheets including at least one sheet of tabbed stock, the sheets having perforations along a first side edge thereof, said machine comprising:

a frame including a support surface configured to support a stack of sheets thereon, said support surface defining a first side portion;

a coil driver mounted to said frame and adapted to rotate a helical coil through the perforations in the sheets; and a guide mounted to said frame and abutting an opposite side edge of the sheets to align the perforations during coil insertion, said guide including a pair of abut a-apart guide surfaces that abut a narrow edge portion of tabbed sheet stock, said guide including a cleared-out portion between said spaced-apart guide surfaces to provide clearance for a tab of the tabbed stock and permitting alignment of the perforations during insertion of the helical coil.

20. A coil-inserting machine as set forth in claim 19, wherein:

said guide surfaces are curved such that the perforations form curved passages when the edges of the sheets abut said guide surfaces.

21. A coil-inserting machine as set forth in claim 20, wherein:

said support surfaces comprise a first pair of guide surfaces having a first curvature equal to a first size helical coil, and including:

a second pair of guide surfaces having a second curvature equal to a second size helical coil; and said guide shiftable to selectively move said first and second guide surfaces into a position abutting a side edge of the stacked sheets.

22. A compact and portable coil inserting machine for binding stacks of sheets having perforations along a first side edge, said machine comprising:

a frame including a support surface shaped to support and position a stack of sheets with the perforations aligned to form passages therethrough, said frame sufficiently lightweight to permit lifting and transport by a user;

an electric motor mounted to said frame;

a coil driver mounted to said frame and connected to said electric motor, actuation of said electric motor rotating the helical coil and driving the helical coil through the passageways formed by the perforations in the sheets;

a foot pedal connected to said electric motor and selectively varying the rotational rate of said electrical motor as the position of said foot pedal is varied by an operator;

said foot pedal is movable between a maximum speed position and a stopped position; and including:

a dynamic braking circuit electrically interconnecting said motor and said foot pedal, said circuit including a resistor that is electrically connected across the terminals of the electric motor when said foot pedal is in said stopped position and braking said electrical motor and coil driver;

said coil driver includes an elongate roller rotatably mounted to said frame along a first side edge of said support surface, said roller abuttingly engaging and rotating a helical coil for insertion thereof into the perforations of the stacked sheets; and a guide having a curved guide surface abuttingly engaging a side edge of the stacked sheets opposite the perforations.

23. A coil-inserting machine as set forth in claim 22, including:

a coil support defining a V-shaped upper surface extending away from said roller and supporting and aligning a helical coil with said roller during insertion of the coil in the stacked sheets.

* * * * *

UNITED STATES PATENT AND TRADEMARK OFFICE

CERTIFICATE OF CORRECTION

PATENT NO. : 6,036,423
DATED : March 14, 2000
INVENTORS : Michael A. Westra et al.

It is certified that error appears in the above-identified patent and that said Letters Patent is hereby corrected as shown below:

Column 6, line 66;
Before "shoulder" insert --internal--.

Column 7, line 23;
"provide" should be --provides--.

Column 11, claim 19, line 48;
"abut a-apart" should be --spaced-apart--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*